US009287074B2

(12) United States Patent
Nam et al.

(10) Patent No.: US 9,287,074 B2
(45) Date of Patent: Mar. 15, 2016

(54) RELAY FOR AUTOMATICALLY SELECTING A MONITORING RANGE

(71) Applicant: SCHNEIDER ELECTRIC INDUSTRIES SAS, Rueil-Malmaison (FR)

(72) Inventors: Wong Yoon Nam, Singapore (SG); Firman Ardiansyah, Singapore (SG); Teoh Yen Fen, Singapore (SG)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 109 days.

(21) Appl. No.: 14/016,496

(22) Filed: Sep. 3, 2013

(65) Prior Publication Data

US 2014/0071577 A1 Mar. 13, 2014

(30) Foreign Application Priority Data

Sep. 13, 2012 (SG) ..... 201206849-0

(51) Int. Cl.
*H01H 47/22* (2006.01)
*H01H 47/02* (2006.01)

(52) U.S. Cl.
CPC ..... *H01H 47/22* (2013.01); *H01H 47/02* (2013.01)

(58) Field of Classification Search
CPC ..... H01H 47/02; H01H 47/22
USPC ..... 361/115
See application file for complete search history.

(56) References Cited

U.S. PATENT DOCUMENTS 3,958,178 A * 5/1976 Mueller et al. ..... 324/115
5,185,705 A * 2/1993 Farrington ..... 700/292
6,331,832 B1 * 12/2001 Rushing ..... 341/139
6,380,726 B1 * 4/2002 Szabo ..... 324/115

(Continued)

FOREIGN PATENT DOCUMENTS

CN 1236105 A 11/1999
CN 1244924 A 2/2000
CN 102332731 A 1/2012

(Continued)

OTHER PUBLICATIONS

Extended European Search Report from corresponding European Application No. 13184092.8 dated Dec. 3, 2014.

(Continued)

*Primary Examiner* — Scott Bauer
(74) *Attorney, Agent, or Firm* — Lando & Anastasi, LLP

(57) ABSTRACT

A relay for automatically selecting a monitoring range for monitoring a parameter of an input source and a method for monitoring a parameter of an input source can be provided whereby the relay comprises one or more terminals for coupling to the input source; a plurality of switchable circuits coupled to the one or more terminals; a processing module coupled to the plurality of switchable circuits for automatically selecting a monitoring range from a plurality of monitoring ranges based on a value of the parameter of the input source, each monitoring range associated with one or more of said switchable circuits; and a relay switch being configured to provide or disrupt electrical communication to a circuit, based on a trigger signal provided by the processing module. A signal conditioning module may also be provided for e.g. conditioning signals prior to selection of the monitoring range.

20 Claims, 11 Drawing Sheets

(56) References Cited

U.S. PATENT DOCUMENTS

| | | | | |
|---|---|---|---|---|
| 2002/0193968 | A1* | 12/2002 | Gamvrelis et al. | 702/188 |
| 2008/0094768 | A1* | 4/2008 | Perra et al. | 361/79 |

FOREIGN PATENT DOCUMENTS

| | | | |
|---|---|---|---|
| EP | 961120 | A2 | 12/1999 |
| EP | 2040279 | A1 | 3/2009 |
| GB | 2336217 | A | 10/1999 |
| JP | H0915266 | A | 1/1997 |
| WO | 2007/114951 | A2 | 10/2007 |

OTHER PUBLICATIONS

International Search and Written Opinion from corresponding Singapore Application No. 201206849-0 dated Jun. 30, 2014.

Office Action from corresponding Chinese Application No. 201310254594.4 dated Nov. 4, 2015.

Office Action from corresponding EP Application No. 13184092.8 dated Jan. 20, 2016.

* cited by examiner

200

RELAY FOR AUTOMATICALLY SELECTING A MONITORING RANGE

CROSS-REFERENCE TO RELATED APPLICATION

This application claims the benefit under 35 U.S.C. §119 of Singapore Patent Application No. 201206849-0 filed on Sep. 13, 2012 which is hereby incorporated herein by reference in its entirety for all purposes.

TECHNICAL FIELD

The present invention relates broadly to a relay for automatically selecting a monitoring range and to a method for monitoring a parameter of an input source.

BACKGROUND

In the electronics industry, devices such as relays are typically used to operate machinery and circuits. Such devices typically rely on energisation or switching on/off for operations.

Conventionally, for monitoring or control operations using a control relay, typically, the relay is specific to monitoring a certain overall parameter range of e.g. a power source, a voltage source, a current source etc. The parameter may be e.g. current, voltage, three-phase power etc. For example, a control relay may be provided for monitoring an overall current range of 0.15 A to 15 A. Practically, that control relay may be provided with different sub-ranges to be chosen by connection of the source to be monitored to different respective terminals. That is, the relay may have multiple input terminals corresponding to different monitoring ranges or sub-ranges. For example, the overall range may be broken up into sub-ranges such as 0.15 A to 1.5 A, 0.5 to 5 A and 1.5 A to 15 A. To monitor a current threshold of 6 A, a user typically needs to connect to two correct terminals (out of multiple terminals) for monitoring a sub-range of 1.5 A to 15 A.

Thus, one significant problem that may arise is that the user may connect the source to be monitored to incorrect terminals and the relay would then not function as desired. This may cause the user to interpret the relay as a malfunctioned product. Furthermore, a connection of a high current source to an incorrect terminal for monitoring a low current range may cause damage to the relay.

In addition, the user needs to know beforehand parameters of the source to be measured (e.g. the load current or the input voltage) in order to match according to product specifications of relays, to select the appropriate relay for monitoring and/or control purposes.

With multiple input terminals, the number for combinatorial permutations for selecting two input terminals (out of many terminals) can increase the complexity of operation of the relay. While user manuals are typically provided to tabulate the corresponding combination of two specific terminals with a particular source to be monitored, looking up such tables can typically be tedious and extremely time consuming.

Furthermore, as the process of looking up tables and identifying the correct input terminals for connection is currently manual in nature, a likelihood of human error still exists which may lead to product malfunction or damage. From a product supplier's perspective, this is highly undesirable as the number of product returns may increase and it may not be possible to differentiate damaged products which are caused by incorrect connection by users or actual defective products caused by e.g. manufacturing processes.

In addition, as the number of input terminals that can be present on a relay is ultimately limited by the usable surface area of the relay, a relay can only support a limited number of sub-ranges. Thus, in reality, different relays with different monitoring ranges are typically provided catering to different parameter thresholds. Therefore, there can be a large number of relays made available for a certain range thus leading to confusion for users. For example, there may be a relay for monitoring 0.003 A to 0.03 A of current, another relay for monitoring 0.01 A to 0.1 A of current, and yet another relay for monitoring sub-ranges 0.1 A to 1 A, 0.3 A to 1.5 A, 1 A to 5 A and 3 A to 15 A of current.

Hence, in view of the above, there exists a need for a relay and a corresponding method that seek to address or ameliorate at least one of the above problems.

SUMMARY

In accordance with a first aspect of the present invention, there is provided a relay for automatically selecting a monitoring range for monitoring a parameter of an input source, the relay comprising one or more terminals for coupling to the input source; a plurality of switchable circuits coupled to the one or more terminals; a processing module coupled to the plurality of switchable circuits for automatically selecting a monitoring range from a plurality of monitoring ranges based on a value of the parameter of the input source, each monitoring range associated with one or more of said switchable circuits; and a relay switch being configured to provide or disrupt electrical communication to a circuit, based on a trigger signal provided by the processing module.

The relay may further comprise a switching module for implementing the switchable circuits, the switching module comprising at least two switches being each operable in an open state or a closed state, wherein the at least two switches may be configured to provide different electrical paths from the input source to the processing module based on their individual open and closed states.

The processing module may be configured to instruct at least one of the switches of the switching module to be in the open state or the closed state based on the value of the parameter of the input source.

The processing module may be configured to sample the value of the parameter of the input source and to assess the plurality of monitoring ranges for automatically selecting the monitoring range.

The assessment may be based on assessing respective upper and lower boundaries of the plurality of monitoring ranges based on the sampled value.

The closed state of each one of the at least two switches may correspond to a respective monitoring range such that each one of the switches remains in its closed state when the value of the parameter is within the respective monitoring range.

The relay may further comprise a resistor array for coupling to the input source, the resistor array comprising a plurality of resistors to provide different electrical resistance from the input source to the processing module.

The processing module may be configured to automatically select the monitoring range based on a voltage drop across the resistor array.

The relay may further comprise no more than two input terminals.

The input parameter may comprise at least one of a voltage and a current of the input source.

The relay may be compatible for use separately with a first input source having a first input parameter and a second input source having a second input parameter, the ratio of the first input parameter to the second input parameter being at least 5000.

No more than one of the at least two switches may be in the closed state at any one point of time.

The relay may further comprise at least one of a voltage protection module or a current protection module coupled to the processing module for substantially preventing damage to the processing module caused by electrical properties of the input source.

The trigger signal may be provided by the processing module when one or more characteristics of the input source meets one or more predetermined conditions.

The one or more characteristics may be selected from a group consisting of single phase voltage, three phase voltage, single phase current and power.

The predetermined conditions may be user set.

In accordance with a second aspect of the present invention, there is provided a method for monitoring a parameter of an input source, the method comprising the steps of coupling a plurality of switchable circuits to the source; obtaining a value of the parameter; selecting a monitoring range from a plurality of monitoring ranges based on the value of the parameter of the input source, each monitoring range associated with one or more of said switchable circuits; and providing or disrupting electrical communication to a circuit, based on a trigger signal based on monitoring the parameter.

The method may further comprise providing a switching module for implementing the switchable circuits, the switching module comprising at least two switches being each operable in an open state or a closed state, wherein the at least two switches may be configured to provide different electrical paths based on their individual open and closed states.

The step of selecting the monitoring range may comprise instructing at least one of the switches of the switching module to be in the open state or the closed state based on the value of the parameter of the input source.

The method may further comprise sampling the value of the parameter of the input source and assessing the plurality of monitoring ranges for automatically selecting the monitoring range.

The method may further comprise assessing respective upper and lower boundaries of the plurality of monitoring ranges based on the sampled value.

The closed state of each one of the at least two switches may correspond to a respective monitoring range such that each one of the switches remains in its closed state when the value of the parameter is within the respective monitoring range.

The method may further comprise coupling a resistor array to the input source, the resistor array comprising a plurality of resistors to provide different electrical resistance to the input source.

The step of automatically selecting the monitoring range may be further based on a voltage drop across the resistor array.

The method may further comprise providing no more than two input terminals for coupling to the input source.

The input parameter may comprise at least one of a voltage and a current of the input source.

A ratio of a first monitoring range to a second monitoring range may be at least 5000.

No more than one of the at least two switches may be in the closed state at any one point of time.

The method may further comprise providing at least one of a voltage protection module or a current protection module for substantially preventing damage caused by electrical properties of the input source.

The trigger signal may be generated when one or more characteristics of the input source meets one or more predetermined conditions.

The one or more characteristics may be selected from a group consisting of single phase voltage, three phase voltage, single phase current and power.

The predetermined conditions may be user set.

The step of selecting the monitoring range may comprise (i) comparing the value of the parameter with a respective monitoring range of one switch of the switching module to determine whether the value is within the monitoring range of that switch; (ii) providing that switch to be in the open state if the value is outside the monitoring range of that switch, or in the closed state if the value is within the monitoring range of that switch; (iii) repeating steps (i) and (ii) with each of the other switches until the value is determined to be inside the monitoring range of one of the switches in the switching module and that switch is provided in a closed state.

In accordance with a third aspect of the present invention, there is provided a computer readable data storage medium having stored thereon computer code means for instructing a processing module of a relay to execute a method for monitoring a parameter of an input source, the method comprising the steps of coupling a plurality of switchable circuits to the source; obtaining a value of the parameter; selecting a monitoring range from a plurality of monitoring ranges based on the value of the parameter of the input source, each monitoring range associated with one or more of said switchable circuits; and providing or disrupting electrical communication to a circuit, based on a trigger signal based on monitoring the parameter.

BRIEF DESCRIPTION OF THE DRAWINGS

Example embodiments of the invention will be better understood and readily apparent to one of ordinary skill in the art from the following written description, by way of example only, and in conjunction with the drawings, in which:

FIGS. 1(*b*)-1(*e*) are schematic circuit diagrams illustrating the relay in the example embodiment of FIG. 1(*a*).

FIG.5(*b*) is a schematic block diagram broadly illustrating components of a current control relay in an example embodiment.

FIG.6(*b*) is a schematic block diagram broadly illustrating components of a voltage control relay in an example embodiment.

DESCRIPTION OF EXAMPLE EMBODIMENTS

Figure 1A:
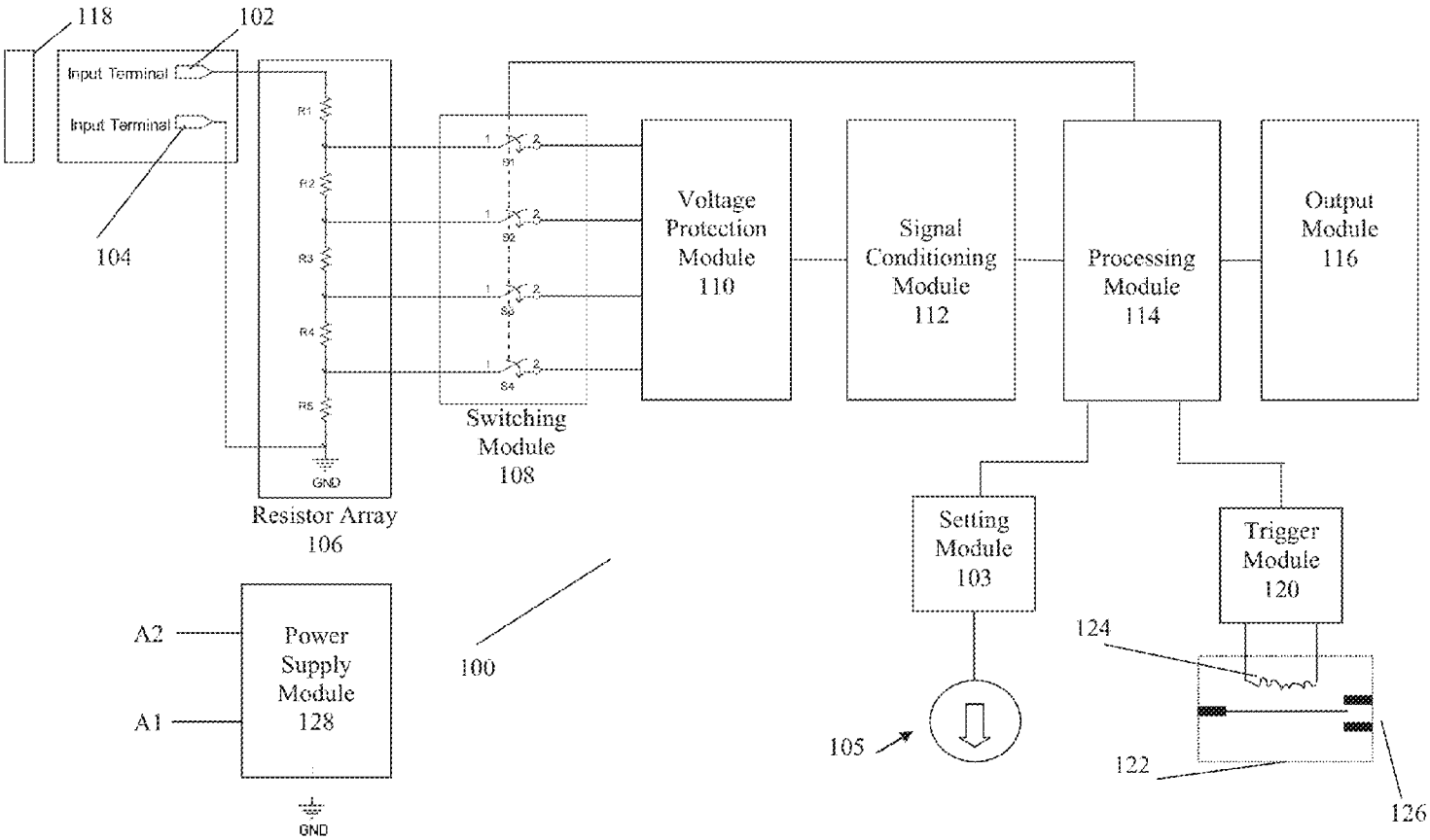
FIG. 1(*a*) is a schematic diagram illustrating a relay in an example embodiment.
Figure 1B:
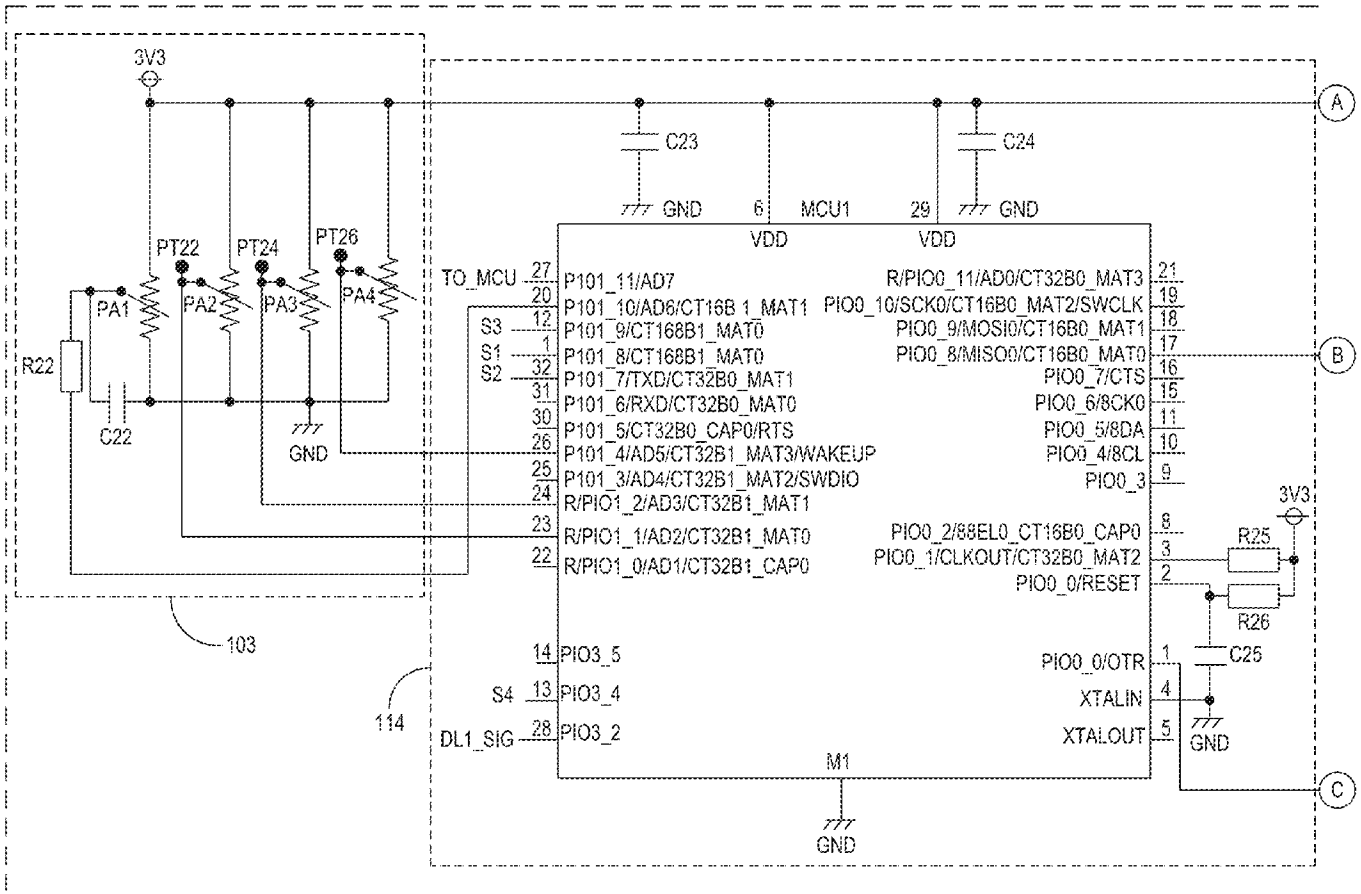
Figure 1C:
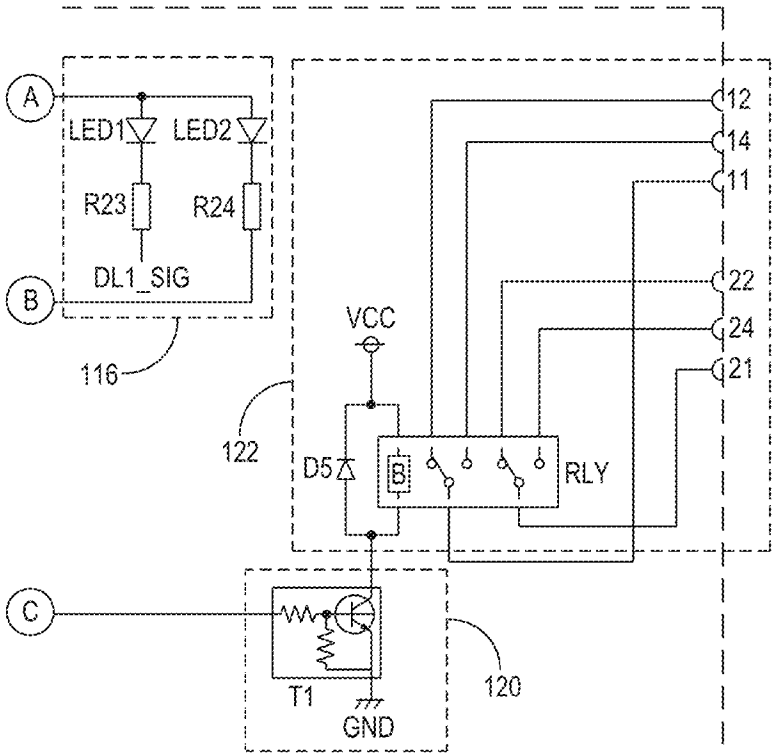
Figure 1D:
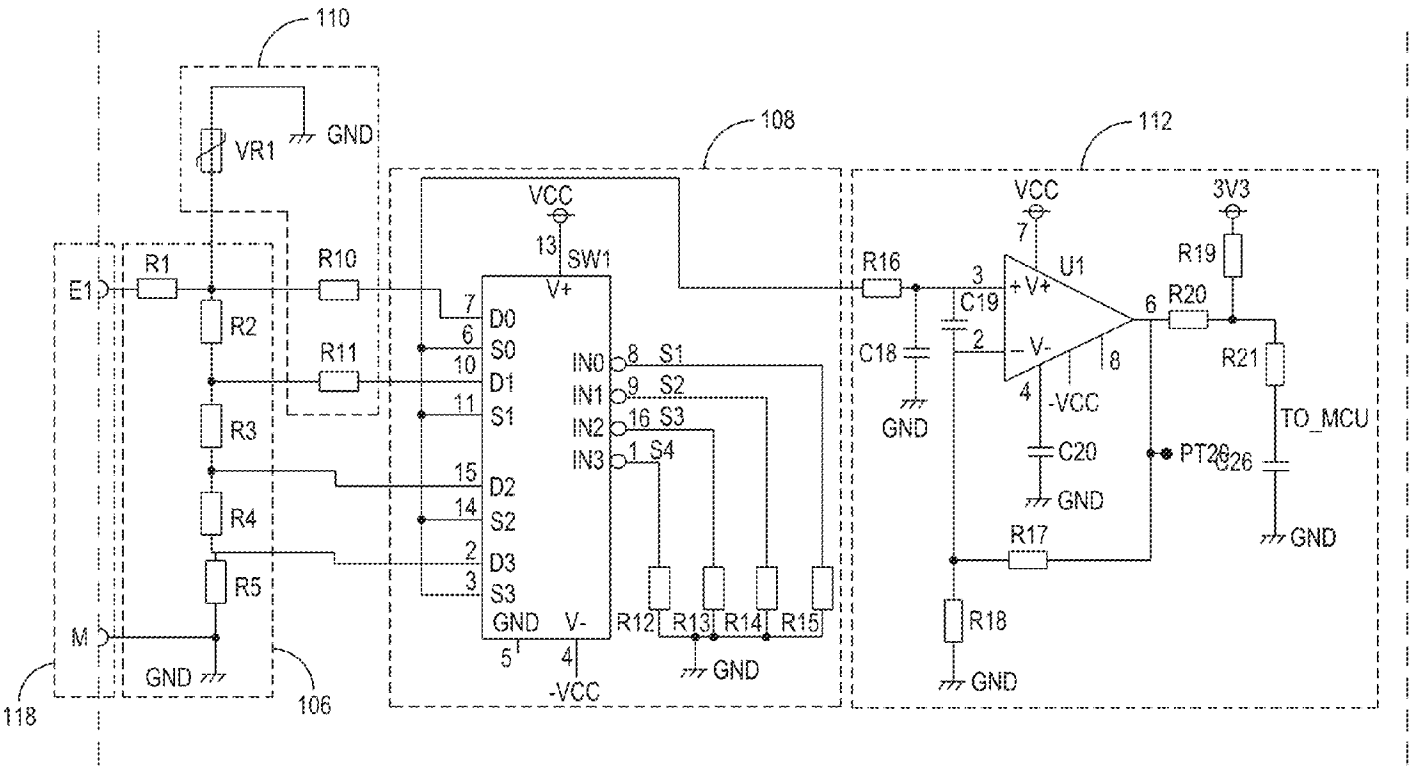
Figure 1E:
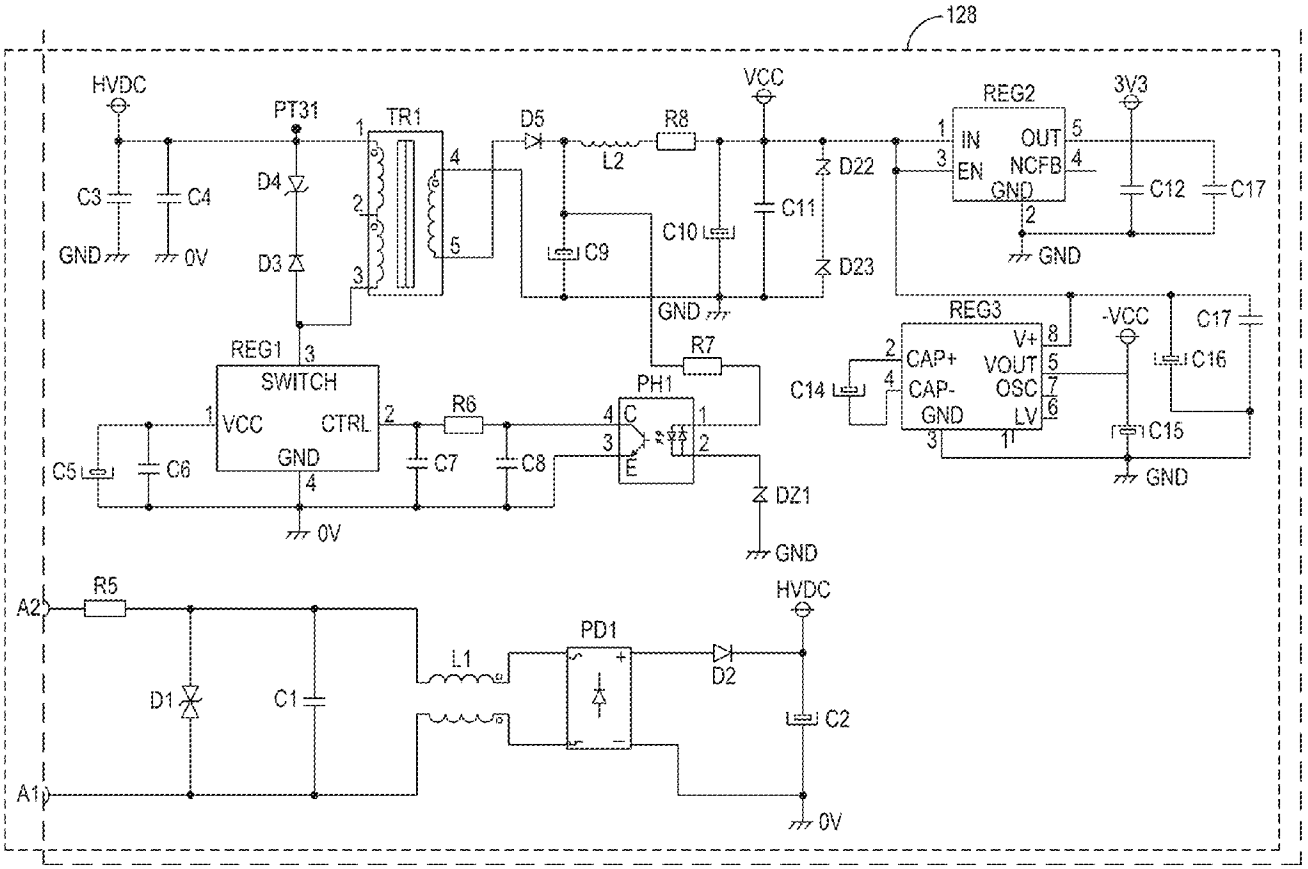

Example embodiments described below can provide a relay for automatically selecting an electrical path therein and a method of automatically selecting an electrical path within said relay.

There can be provided a relay that allows automatic range selection for monitoring to allow users ease of connection and being user friendly. A user can simply connect an input source to be monitored to, preferably, one terminal and set an appropriate threshold at a front panel of the relay, for operating the relay. The relay can then measure e.g. a root-mean-square (RMS) value to determine/select an appropriate monitoring range for use with the source to be monitored. The appropriate monitoring range is selected based on selecting an electrical path from the input source to a processing module. In example implementations, a current range can be from 2 mA to 15 A (with sub-ranges in-between) and a voltage range can be from 50 mV to 600V (with sub-ranges in-between).

In example embodiments, there can be provided a relay for automatically selecting a compatible electrical path therein for an input source. The relay comprises a resistor array having a resistor array comprising a plurality of resistors; a switching module coupled to the resistor array, the switching module comprising at least two switches being each operable in an open state or a closed state; a processing module coupled to the switching module for automatically controlling the operation of the at least two switches in the switching module; and a relay switch coupled to the processing module and the relay switch is configured to provide or disrupt electrical communication to a circuit, based on a trigger signal provided by the processing module, wherein the at least two switches are configured to provide different electrical paths from the input source to the processing module based on their individual open and closed states. In certain embodiments, the compatible electrical path is the path which allows the relay to monitor the input source with a compatible/appropriate monitoring range and can substantially reduce the likelihood of damage of the relay by the input source. In certain embodiments, the processing module obtains a first reading of a parameter value of the input source to be monitored and compares the reading to stored/known boundaries of different monitoring ranges. The processing module then decides which switch or switches to activate to select a compatible electrical path to monitor the input source with a compatible/appropriate monitoring range.

In the description herein, a relay can be an energisable coil device that can include, but is not limited to, any device that can be switched/powered on and off such as an electrical relay or other electromechanical switching devices, components or parts. An energisation event of an energisable coil device can include, but is not limited to, an electrical powering on/off of the element and/or a mechanical switching on/off of the element.

The terms "coupled" or "connected" as used in this description are intended to cover both directly connected or connected through one or more intermediate means, unless otherwise stated.

The description herein may be, in certain portions, explicitly or implicitly described as algorithms and/or functional operations that operate on data within a computer memory or an electronic circuit. These algorithmic descriptions and/or functional operations are usually used by those skilled in the information/data processing arts for efficient description. An algorithm is generally relating to a self-consistent sequence of steps leading to a desired result. The algorithmic steps can include physical manipulations of physical quantities, such as electrical, magnetic or optical signals capable of being stored, transmitted, transferred, combined, compared, and otherwise manipulated.

Further, unless specifically stated otherwise, and would ordinarily be apparent from the following, a person skilled in the art will appreciate that throughout the present specification, discussions utilizing terms such as "scanning", "calculating", "determining", "replacing", "generating", "initializing", "outputting", and the like, refer to action and processes of a instructing processor/computer system, or similar electronic circuit/device/component, that manipulates/processes and transforms data represented as physical quantities within the described system into other data similarly represented as physical quantities within the system or other information storage, transmission or display devices etc.

The description also discloses relevant device/apparatus for performing the steps of the described methods. Such apparatus may be specifically constructed for the purposes of the methods, or may comprise a general purpose computer/processor or other device selectively activated or reconfigured by a computer program stored in a storage member. The algorithms and displays described herein are not inherently related to any particular computer or other apparatus. It is understood that general purpose devices/machines may be used in accordance with the teachings herein. Alternatively, the construction of a specialized device/apparatus to perform the method steps may be desired.

In addition, it is submitted that the description also implicitly covers a computer program, in that it would be clear that the steps of the methods described herein may be put into effect by computer code. It will be appreciated that a large variety of programming languages and coding can be used to implement the teachings of the description herein. Moreover, the computer program if applicable is not limited to any particular control flow and can use different control flows without departing from the scope of the invention.

Furthermore, one or more of the steps of the computer program if applicable may be performed in parallel and/or sequentially. Such a computer program if applicable may be stored on any computer readable medium. The computer readable medium may include storage devices such as magnetic or optical disks, memory chips, or other storage devices suitable for interfacing with a suitable reader/general purpose computer. The computer readable medium may even include a wired medium such as exemplified in the Internet system, or wireless medium such as exemplified in bluetooth technology. The computer program when loaded and executed on a suitable reader effectively results in an apparatus that can implement the steps of the described methods.

The example embodiments may also be implemented as hardware modules. A module is a functional hardware unit designed for use with other components or modules. For example, a module may be implemented using digital or discrete electronic components, or it can form a portion of an entire electronic circuit such as an Application Specific Integrated Circuit (ASIC). A person skilled in the art will understand that the example embodiments can also be implemented as a combination of hardware and software modules.

FIG. 1(*a*) is a schematic diagram illustrating a relay in an example embodiment. In the example embodiment, the relay is a control relay 100. The relay 100 is configured to be coupled to an input source 118 to be monitored such as a single phase power supply line voltage source. The relay 100 can detect values of one or more parameters of the source to be monitored.

FIGS. 1(*b*)-1(*e*) are schematic circuit diagrams illustrating the relay 100 in the example embodiment of FIG. 1(*a*).

In the example embodiment, the relay 100 comprises a resistor array 106 coupled to a switching module 108. The switching module 108 is coupled to a protection module 110 in the form of a voltage protection module. The voltage protection module is coupled to a signal conditioning module 112 which is further coupled to a processing module 114. The processing module 114 is coupled to an output module 116. The processing module 114 is also coupled to a setting module 103 that is in turn coupled to a user interface 105. The processing module 114 is further coupled to a trigger module 120 that can control a trigger switch 122 of the relay 100. The resistor array 106 can couple to an input source 118 using e.g. two input terminals 102 and 104. A power supply module 128 can be provided to supply power to the various components of the relay 100. The relay 100 may also be coupled to a programmable logic controller (not shown) for feedback.

In some example embodiments, the source indicated at numeral 118 is not limited to a single phase voltage and can include various parameters for sources to be monitored such as three-phase voltage and single phase current. Other parameters such as power of a three-phase power supply may also be monitored.

The resistor array 106 comprises a plurality of resistors e.g. R1, R2, R3, R4 and R5 arranged in series (e.g. when the switches of the switching module 108 are open). The switching module 108 comprises a plurality of switches e.g. S1, S2, S3 and S4 arranged in parallel. The voltage protection module 110 comprises a voltage suppressor and current limiting resistors to regulate the voltage to an amount insufficient to cause substantial damage to the processing module 114. The voltage protection module 110 steps down and shifts a voltage level of the input source to a voltage level that does not damage the processing module 114. The signal conditioning module 112 comprises capacitors (not shown) which are included for noise filtering purposes. The signal conditioning module 112 which comprises an operational amplifier circuit further conditions the electrical properties of the incoming signal to a form/level suitable for processing by the processing module 114. It will be appreciated that the resistor array 106 can have different circuit arrangements or number of resistors in order to adapt to various kinds of e.g. physical input parameters from different sources for monitoring by the processing module 114. Likewise, the switching module can have different circuit arrangements or number of switches in order to adapt and provide different compatible electrical pathways to various kinds of input parameters from different sources for monitoring by the processing module 114.

The processing module 114 accepts inputs from the signal conditioning module 112 and conducts processing. In the example embodiment, the processing module 114 can accept a sampled parameter value (e.g. a voltage level or current value) sampled from the input source 118 and compares it against different monitoring ranges represented by or associated with each of the different switches in the switching modules. The monitoring ranges may be pre-determined and stored in a database of a memory (not shown). The processing module 114 controls the opening or closing of each of the switches depending on whether the sampled parameter value is within the monitoring range of each switch.

For example, the sampled parameter value may be a voltage of 0.4V and this voltage is within the voltage monitoring range associated with S1 (e.g. range of 0.05V to 0.5V) but outside the voltage monitoring range associated with S2 (e.g. range of 0.51V to 5V), S3 (e.g. range of 5.01V to 50V) and S4 (e.g. range of 50.01V to 600V). In this example embodiment, S1 is provided to be in a closed state while the remaining switches S2, S3 and S4 are provided in the opened state to select the appropriate monitoring range and compatible electrical path. Current thus travels from the input source 118 to the processing module 114 via resistor R1 and switch S1. Accordingly, the electrical path from the input source terminal 102 to switch S1 has a resistance of R1 and the voltage drop at S1 can be computed using (R2+R3+R4+R5)/(R1+R2+R3+R4+R5). In this example embodiment, if the switch S2 is closed instead, the electrical path from the input terminal 102 to switch S2 has a resistance of (R1+R2) and the voltage drop at S2 can be computed using (R3+R4+R5)/(R1+R2+R3+R4+R5). The same logic applies for the other switches. Once the appropriate compatible electrical path is established, the processing module 114 continues to monitor sampled parameter value (e.g. the voltage level or current value) sampled from the input source 118 against the selected monitoring range associated with the relevant switch and electrical path, and compares the parameter value against a set of one or more predetermined conditions (e.g. a set threshold). These predetermined conditions can be working/threshold conditions set by the user, preset during manufacturing or automatically set by the relay. Compare user interface 105. The working conditions determine if the relay switch 122 is to be opened or closed.

The processing module 114 can comprise a microcontroller. The microcontroller can be implemented using e.g. STM32F100C from STMicroelectronics or LPC1114 from NXP. Other components may be provided connected to the microcontroller as a supporting circuit to enable the microcontroller to function. It will be appreciated that the supporting circuit can vary depending on the type of microcontroller selected for implementation. In the example embodiment, the processing module 114 functions as an intelligent process element that interacts with the components within the relay 100. Processing in the processing module 114 is dependent on the firmware written.

The user interface 105 can comprise external manipulated elements to be accessed by a user of the relay 100, e.g. for setting working/threshold conditions. The manipulation or setting set by the user on the user interface 105 is sensed by the setting module 103 and is translated into an electrical signal at the setting module 103. The signal is transmitted to the processing module 114 for processing at the processing module 114.

There are various types of manipulation or settings depending on the type of relay 100. In this example, some possible manipulation or setting can include, but not limited to, under-voltage setting, over-voltage setting etc. Hysteresis setting can be included as well. The settings set via the user interface 105 provide one or more threshold levels or "sets of conditions" that the relay 100 uses at the processing module 114 in order to determine whether the parameter values sampled at the source at numeral 118 fall within a working range based on these "sets of conditions".

In the example embodiment, the setting module 103 comprises a plurality of potentiometers meant for converting the setting set by the user at the user interface 105 to an electrical signal that can be transmitted and recognized by the processing module 114. For example, a first potentiometer can translate an under-voltage/over-voltage selector; a second potentiometer can translate a voltage range setting; and a third potentiometer can translate a desired voltage threshold by user. For example, the second potentiometer can be used to select 600V as the working condition. The third potentiometer can be used to select a value of 30%, thus translating to an actual/desired under- or overvoltage (depending on which is chosen) threshold of 180V deviation (i.e. 30% of 600V). It will be appreciated that the setting module 103 is not limited as such and can be expanded to more settings such as hysteresis, time setting etc.

Therefore, in the example embodiment, in order not to obtain erroneous readings, the correct monitoring range is first selected (via a compatible electrical path) for monitoring the parameter value. Thereafter, if a monitored value of the parameter of the source to be monitored falls outside the working range/predetermined conditions, a trigger signal is transmitted. In the example embodiment, the trigger signal can be transmitted by the processing module 114 instructing the trigger module 120 to control the relay switch 122.

The trigger module 120 comprises a transistor for driving or controlling the trigger switch 122. In the example embodiment, when the transistor is turned ON, the trigger switch 122 is energized or switched on. When the transistor is turned OFF, the trigger switch 122 is de-energized or switched off. It will be appreciated that there are various possibilities to modify the design and/or to reverse the above logic depending on designer preference. The trigger signal can be a feedback signal to a programmable logic controller (not shown) for alerting the user.

In the example embodiment, the trigger switch 122 can be constructed as an electro-mechanical relay switch. The trigger switch 122 comprises a coil portion 124 and a contact portion 126. The coil portion 124 can be energized or de-energized by the trigger module 120 in order to switch the position or logic of the contact portion 126. It will be appreciated that the switch element can be any of electro-mechanical relay or solid-state switch.

In the example embodiment, optionally, a storage element or memory (not shown) may be provided. The memory can store all the information related to the parameters detected at the processing module 114. For example, the memory can store all instantaneous information of a single phase voltage, the information including instantaneous voltage level, historical voltage level, frequency, historical faults that had happened etc. The memory can be, but not limited to, an external memory module such as EEPROM, FLASH, PROM etc., or an integrated memory circuit embedded into the processing module 114.

In the example embodiment, optionally, a transceiver integrated circuit (not shown) can be provided. The transceiver integrated circuit can transmit and receive information wirelessly or through a wired-medium to and from the relay 100, in communication with external devices such as a mobile phone, a computer, and/or a programmable logic controller. The transceiver integrated circuit can be, but not limited to, a Bluetooth transceiver, a Wifi transceiver, a Zigbee transceiver, a universal serial bus (USB) transceiver, a Serial Port transceiver etc.

Therefore, in the example embodiment, the relay 100 can function as a control & monitoring device for monitoring physical input parameters and of an input source. In the example embodiment, the relay 100 is also compatible with different input sources. The relay 100 can provide the most compatible electrical path for the relay to perform its control and monitoring functions accurately with an appropriate monitoring range, and with a reduced likelihood of damage caused by incompatibility between for example, the voltage/current ratings of the input source and the components of the relay.

The relay 100 can reflect a status of the input source to be monitored in terms of a digital format/feedback. This may be a trigger signal in terms of "closing a contact" or "opening a contact" if the trigger switch 122 is an electro-mechanical relay or in terms of "ON" or "OFF" if the trigger switch 122 is a solid-state switch. The relay 100 can be powered by a separate source of supply voltage or share the same source of supply voltage as the physical input parameters of the source to be monitored. In the example embodiment, the power source is preferably a single phase power source, although other kinds of power sources may also be used. It will be appreciated that the power source may be either an alternating current (AC) or direct current (DC) power.

Figure 2:
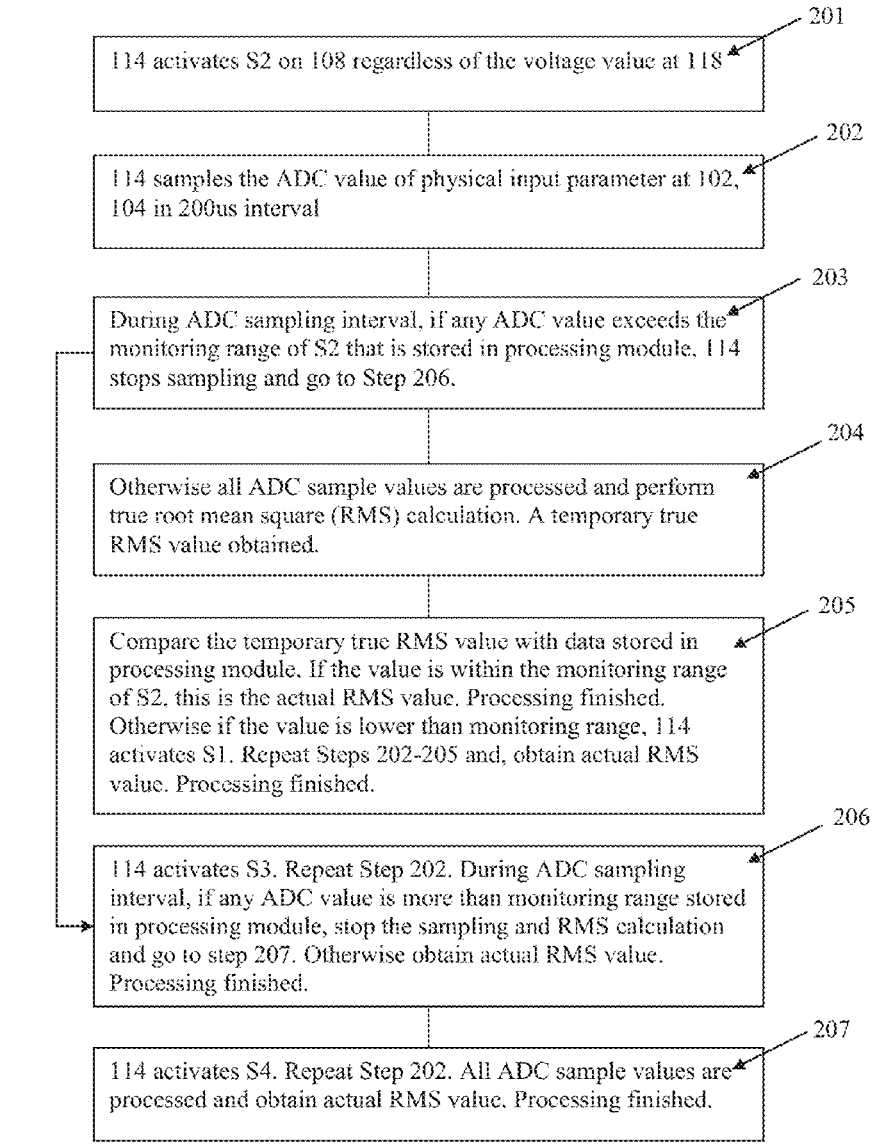
FIG. 2 is a schematic flow diagram for broadly illustrating an algorithm of an exemplary firmware for a processing module in an example embodiment.

FIG. 2 is a schematic flow diagram 200 for broadly illustrating an algorithm of an exemplary firmware for the processing module 114 of FIG. 1 in an example embodiment. The processing module 114 can select an electrical path within the relay of FIG. 1 to be compatible with and for monitoring the input source with an appropriate monitoring range.

At step 201, the processing module 114 activates switch S2 of the switching module 108 to be in the closed state regardless of the voltage value of the input source 118. This is to enable a first reading to be taken to determine a monitoring range. S2 being closed is arbitrary and it is conceivable that any of the switches can be closed instead or in combination.

At step 202, the processing module 114 samples the analogue to digital converted (ADC) value of the input parameter obtained at terminals 102, 104 in 200 μs intervals. At step 203, the sample ADC value is monitored against the monitoring range associated with the closed switch(es), i.e. S2. The monitoring range may be stored in the processing module 114. If the sampled ADC value exceeds the monitoring range associated with S2, the processing module 114 stops sampling and proceeds to step 206. That is, the processing module 114 determines that the ADC value is above the upper boundary of the monitoring range and thus, the monitoring range is not appropriate and another monitoring range is to be used. In the example embodiment, instantaneous ADC values are compared against upper boundaries during the ADC sampling process because the inventors have recognised that if any parameter being monitored is higher than the maximum limit associated with the switch, the ADC value obtained is the maximum ADC value of e.g. the microcontroller only (e.g. value 1023 for a 10-bit ADC port), thus causing/signalling an incorrect measurement.

Otherwise, at step 204, the processing module 114 next attempts to determine whether that the ADC value is within the monitoring range by assessing against the lower boundary of the monitoring range. The ADC sample values are processed and a true root mean square (RMS) calculation is performed to obtain a temporary true RMS value.

Subsequently, at step 205, the temporary true RMS value is compared with data stored in the processing module 114, i.e. the lower boundary of the monitoring range. In the example embodiment, RMS values are used for such comparisons because the inventors have recognised that a true RMS value is e.g. a voltage reading that does not depend on the shape of the signal, i.e. regardless of whether the signal is in sinusoidal, triangular, square or distorted shape and in various frequencies of waveform etc. A RMS value can be a useful measurement for real world waveforms as compared to other methods such as peak detection or the averaging method. If the RMS value is within the monitoring range associated with switch S2, then the temporary true RMS value is taken to be the actual true RMS value and switch S2 is determined to remain closed, for the appropriate monitoring range to be used to monitor the parameter. However, if the temporary true RMS value is lower than lower boundary of the monitoring range associated with switch S2, the processing module 114 activates the switch S1 to be in the closed state while activating switch S2 to be in the open state. That is, the monitoring range associated to S2 is not appropriate and another lower monitoring range is to be used. The steps 202 to 205 are then repeated with switch S1 in the closed state.

As mentioned above, if the sampled ADC value exceeds the monitoring range of S2 that is stored in the processing module 114 in step 203, the processing module 114 stops sampling and proceeds to step 206. In step 206, the processing module 114 activates a switch S3 to be in the closed state while activating switch S2 to be in the open state. That is, the monitoring range associated to S2 is not appropriate and another higher monitoring range is to be used. The steps 202 to 205 are repeated with switch S3 in the closed state. If the ADC value obtained still exceeds the predetermined monitoring range associated with switch S3, the processing module 114 determines that the ADC value is above the upper boundary of the monitoring range and thus, the monitoring range is not appropriate and another monitoring range is to be used. That is, step 207 is taken. Otherwise, it is determined that the monitoring range associated with switch S3 is appropriate and actual RMS values are obtained to monitor the parameter.

At step 207, after determining that the monitoring range associated with switch S3 is not appropriate, the processing module 114 activates the switch S4 to be in the closed state while activating switch S3 to be in the open state. Step 202 onwards is repeated. Actual RMS values are obtained to monitor the parameter against the monitoring range associated with switch S4.

Once the true RMS value has been obtained from the above algorithmic process, the RMS value may be subsequently used to determine whether a trigger signal is to be sent to the relay switch 122 for switching it on. That is, upon determining an appropriate monitoring range, the RMS value can be monitored against threshold conditions to determine whether the relay switch 122 is to be triggered.

It will be appreciated that more than four switches in the switching module may be present and more than five resistors in the resistor array may be present. In such cases, the general concept of the above algorithm can still apply accordingly with variations to suit the number of resistors and switches added. Further, although the algorithm proceeds by checking against an upper boundary of a monitoring range, the algorithm is not limited as such and can proceed by first checking against a lower boundary of a monitoring range to make switch decisions thereon. In the above algorithm, the respective upper and lower boundaries of the plurality of monitoring ranges are assessed using the sampled parameter value.

As an illustrative example, a relay having an architecture similar to that shown in FIGS. 1(*a*) and 1(*b*)-1(*e*), and a process algorithm similar to that of FIG. 2 may have the following characteristics: The resistor R1 has a resistance of about 900k (or 900,000) ohms, the resistor R2 has a resistance of about 90k ohms, the resistor R3 has a resistance of about 9 k ohms, the resistor R4 has a resistance of about 900 ohms, the resistance R5 has a resistance of about 100 ohms; the microcontroller has a ADC voltage, Vdd of about 3.3V; the microcontroller has a ADC bit of 10 bit (e.g. ADC count =0 - 1023); the signal conditioning module 112 has a gain of 38.4; the RMS voltage monitoring range associated with S1 is 0.05-0.5V; the voltage monitoring range associated with S2 is 0.51-5V; the voltage monitoring range associated with S3 is 5.01-50V; the voltage monitoring range associated with S4 is 50.01-600V.

In the above illustrative example, if the voltage sampled from input source 118 is from a sinusoidal waveform with a 100V peak (e.g. RMS=70.7V), the following steps take place (Reference is made to the steps of FIG. 2 for illustration). At step 201, the processing module 114 activates switch S2 of the switching module 108 to be in the closed state regardless of the voltage value of the input source 118. At step 202, the processing module 114 samples the input voltage. The voltage drop at S2 is (R3+R4+R5)/(R1+R2+R3+R4+R5)×100V, or about 1V peak. This value is passed to the signal conditioning module 112 to condition the signal gain by multiplying the 1V peak voltage with the gain of 38.4. The output conditioned signal is limited by a saturation cap of the Vdd value of 3.3V. Thus, in this case, the conditioned signal value obtained is (1V×38.4 or 3.3V whichever lower) 3.3V peak. The 3.3V peak value is then used by the microcontroller of the processing module to calculate the ADC count based on the following calculation: 3.3/3.3×1023=1023 max. Since this value of 1023 signifies that the monitoring range of S2 is exceeded, the processing proceeds to the next step 206.

In step 206, the processing module 114 activates the switch S3 to be in the closed state while activating switch S2 to be in the open state. The voltage drop at S3 is (R4+R5)/(R1+R2+R3+R4+R5)×100V, or about 0.1V peak. This value is passed to the signal conditioning module 112 to condition the signal gain by multiplying the 0.1V peak voltage with the gain of 38.4. The output conditioned signal is limited by a saturation cap of 3.3V. Thus, in this case, the conditioned signal value obtained is (0.1V×38.4 or 3.3V whichever lower) 3.3V peak. The 3.3V peak value is then used by the microcontroller of the processing module to calculate the ADC count based on the following calculation: 3.3/3.3×1023=1023 max. Since this value of 1023 signifies that the monitoring range of S3 is exceeded, the processing proceeds to the next step 207.

In step 207, the processing module 114 activates the switch S4 to be in the closed state while activating switch S3 to be in the open state. The voltage drop at S4 is (R5)/(R1+R2+R3+R4+R5)×100V, or about 0.01V peak. This value is passed to the signal conditioning module 112 to condition the signal gain by multiplying the 0.01V peak voltage with the gain of 38.4. The output conditioned signal is limited by a saturation cap of 3.3V. Thus, in this case, the conditioned signal value obtained is (0.01V×38.4 or 3.3V whichever lower) about 0.384V peak. The 0.384V peak value is then used by the microcontroller of the processing module to calculate the ADC count based on the following calculation: 0.384/3.3×1023, or count of 119 max. Since this value of 119 signifies that the voltage sampled lies within the monitoring range of S4, the switch S4 is kept in the closed state. The actual RMS value of 70.7V is subsequently obtained and used to determine whether a trigger signal is to be sent to the relay switch 122 for switching it on.

In the above illustrative example, if the voltage sampled from input source 118 is from a sinusoidal waveform with a 0.1V peak (e.g. RMS=0.07V), the following steps take place (Reference is made to the steps of FIG. 2 for illustration). At step 201, the processing module 114 activates switch S2 of the switching module 108 to be in the closed state regardless of the voltage value of the input source 118. At step 202, the processing module 114 samples the input voltage. The voltage drop at S2 is (R3+R4+R5)/(R1+R2+R3+R4+R5)×0.1V, or about 0.001V peak. This value is passed to the signal conditioning module 112 to condition the signal gain by multiplying the 0.001V peak voltage with the gain of 38.4.

The output conditioned signal is limited by a saturation cap of the Vdd value of 3.3V. Thus, in this case, the conditioned signal value obtained is (0.001V×38.4 or 3.3V whichever lower) 0.0384V peak. The 0.0384V peak value is then used by the microcontroller of the processing module to calculate the ADC count based on the following calculation: 0.0384/3.3×1023=12 max. Since this value of 12 signifies that the monitoring range of S2 is not exceeded, the processing proceeds to the steps 204 and 205. The actual RMS value is subsequently obtained and used to determine whether it is within the monitoring range of S2, i.e. by comparing against the lower boundary associated with S2. Since this RMS value of approximately 0.07V signifies it is lower than the monitoring range of S2 (e.g. 0.51-0.5V), this indicates that a measurement obtained with S1 closed is more accurate.

Thus, at step 205, the processing module 114 activates the switch S1 to be in the closed state while activating switch S2 to be in the open state. The voltage drop at S1 is (R2+R3+R4+R5)/(R1+R2+R3+R4+R5)×0.1V, or about 0.01V peak. This value is passed to the signal conditioning module 112 to condition the signal gain by multiplying the 0.01V peak voltage with the gain of 38.4. The output conditioned signal is limited by a saturation cap of 3.3V. Thus, in this case, the conditioned signal value obtained is (0.01V×38.4 or 3.3V whichever lower) about 0.384V peak. The 0.384V peak value is then used by the microcontroller of the processing module to calculate the ADC count based on the following calculation: 0.384/3.3×1023, or a count of 119 max. This can confirm that the monitoring range of S1 is not exceeded. The actual RMS value of 0.07V is subsequently obtained and used to determine whether a trigger signal is to be sent to the relay switch 122 for switching it on.

Figure 3:
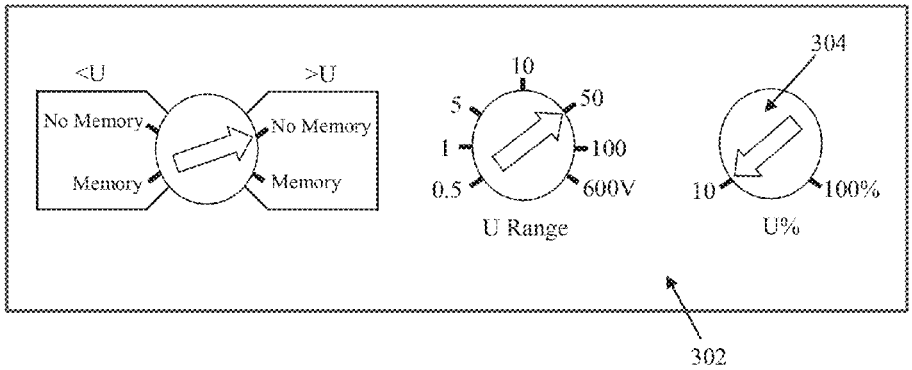
FIG. 3 is a schematic diagram illustrating an interface allowing a user to set predetermined conditions such as threshold levels in an example embodiment.

FIG. 3 is a schematic diagram illustrating an interface allowing a user to set predetermined conditions such as threshold levels in an example embodiment. The interface 302 comprises one or more potentiometers e.g. 304. The user can manipulate a potentiometer e.g. 304 for overvoltage at 10% of a setting value. Thus, if a monitored voltage exceeds 10% of a setting value of a normal working condition, a fault is detected. It will be appreciated that in other embodiments, instead of setting the threshold levels based on percentages, the user may be able to set the exact threshold levels (i.e. a working range) before a fault is detected.

In an example embodiment, if a storage module is provided, the working condition information can be stored for future use. Further, an actuator such as a button and/or a sliding door can be provided to a teach module of a relay (not shown) so that a user can manipulate the actuator to send an instructional input for instructing the relay to access a present detected parameter value for determining/setting the working condition, and to disregard any previous stored working condition information. As yet another alternative, the relay can be instructed to determine/set the working condition at each powering-up of the relay, that is, each initial detection of a power supply to the relay acts as an instructional input.

In an example embodiment, the trigger signal can also function to send a visual indication/display to a user. For example, the trigger signal can be transmitted to a light emitting diode (LED) circuit that instructs an LED to be lit when a corresponding parameter is detected to have a value outside its determined working range. For example, an overvoltage LED may be lit if a detected voltage level is determined to be outside e.g. a 5% tolerance from a working condition for the voltage and an overcurrent LED may be lit if a detect current level is determined to be outside e.g. 2% tolerance from a working condition for the current.

Thus, in the described example embodiments, the relay is capable of setting a working condition based on a detected value of a parameter of a source to be monitored. A working range can then be set based on applying a threshold level to the set working condition. If another detected value of the parameter is outside the working range, a trigger signal can be sent from the relay. This may include a visual indication to the user.

Figure 4:
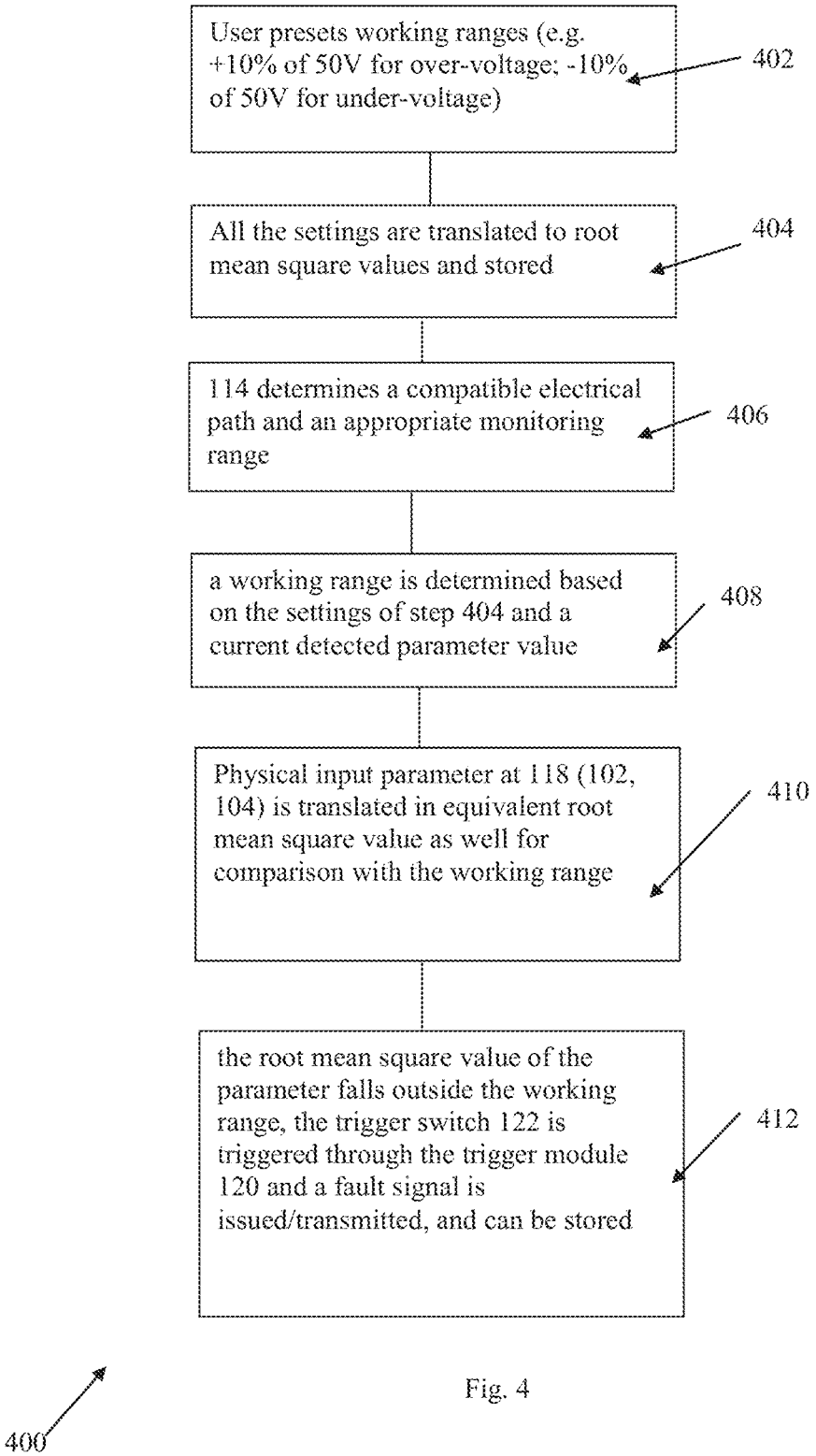
FIG. 4 is a schematic flow diagram for broadly illustrating a triggering algorithm of an exemplary firmware for a processing module in an example embodiment.

FIG. 4 is a schematic flow diagram 400 for broadly illustrating a triggering algorithm of an exemplary firmware for the processing module 114 of FIG. 1 in an example embodiment. The processing module 114 can determine whether a trigger signal is to be sent to the relay switch 122 for switching it on.

At step 402, a user inputs desired predetermined working conditions on the relay 100 to set the boundaries on when the relay 100 should activate/trip (i.e. relay switch 122 switched off). For example, the user can set +10% of 50V for overvoltage (i.e. the relay trips if the voltage increases to more than 10% of 50V which is 5V of the input source) or −10% of 50V for under-voltage (i.e. the relay trips if the voltage decreases to more than 10% of 50V which is 5V of the input source).

At step 404, the working conditions settings are translated to root mean square values and stored. At step 406, the processing module 114 determines a compatible electrical path and an appropriate monitoring range (compare FIG. 3).

At step 408, a working range is determined based on the settings of step 404 and a current detected parameter value. At step 410, the parameter value at numeral 118 (using terminals 102,104) is translated in equivalent root mean square value for comparison with the working range.

At step 412, if the root mean square value of the parameter falls outside the working range, the trigger switch 122 is triggered through the trigger module 120 and a fault signal is issued/transmitted, and can be stored.

Figure 5A:
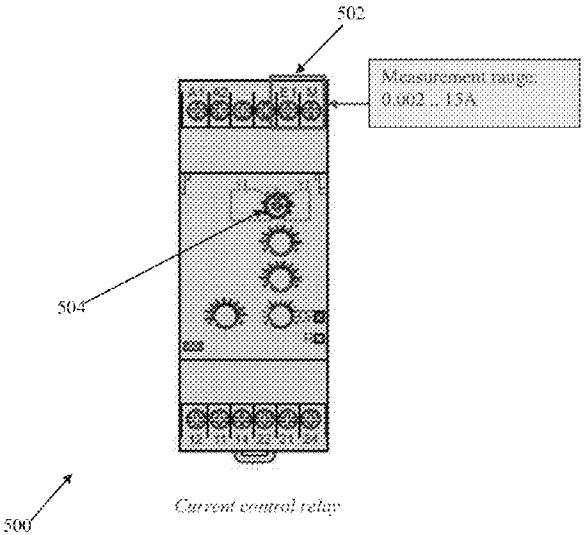
FIG.5(*a*) is a schematic drawing illustrating a current control relay in an example embodiment.
Figure 5B:
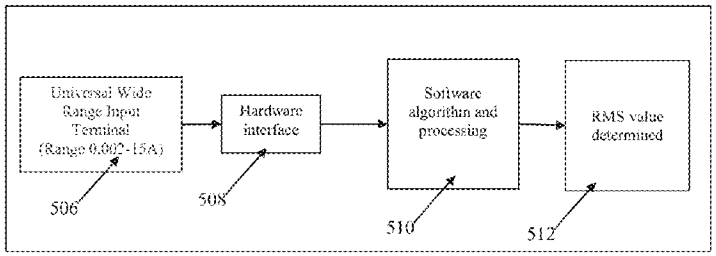

FIG. 5 (*a*) is a schematic drawing illustrating a current control relay in an example embodiment. The relay 500 comprises one terminal pair E1-M 502 for connecting to an input source to be monitored. A threshold setting interface 504 is provided for a user to enter a threshold setting.

FIG. 5 (*b*) is a schematic block diagram broadly illustrating components of a current control relay in an example embodiment. Block 506 is provided to receive a wide range of input current sources, e.g. from 0.002 A to 15 A. A hardware interface 508 is provided to comprise e.g. a resistor array and a switching module. A processing block 510 is coupled to the interface 508 for controlling the interface 508 and selecting an appropriate electrical path via the interface 508 from the block 506 to the processing block 510. The electrical path is selected based on a monitoring range selected or determined based on the input source at block 506. Block 512 is provided to output a RMS value of the current of the input source for monitoring by the selected monitoring range.

Figure 6A:
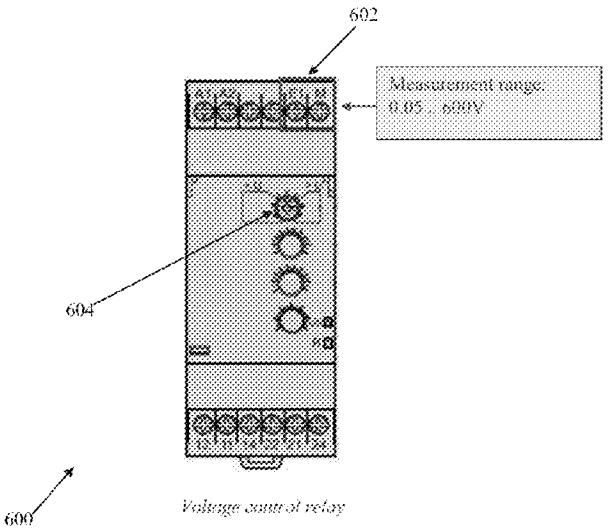
FIG.6(*a*) is a schematic drawing illustrating a voltage control relay in an example embodiment.
Figure 6B:
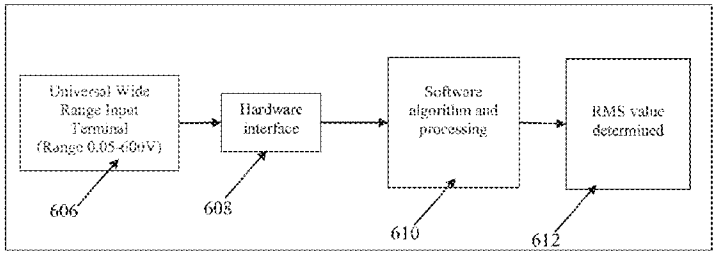

FIG. 6 (*a*) is a schematic drawing illustrating a voltage control relay in an example embodiment. The relay 600 comprises one terminal pair E1-M 602 for connecting to an input source to be monitored. A threshold setting interface 604 is provided for a user to enter a threshold setting.

FIG. 6 (*b*) is a schematic block diagram broadly illustrating components of a voltage control relay in an example embodiment. Block 606 is provided to receive a wide range of input voltage sources, e.g. from 0.05V to 600V. A hardware interface 608 is provided to comprise e.g. a resistor array and a switching module. A processing block 610 is coupled to the interface 608 for controlling the interface 608 and selecting an appropriate electrical path via the interface 608 from the block 606 to the processing block 610. The electrical path is selected based on a monitoring range selected or determined based on the input source at block 606. Block 612 is provided to output a RMS value of the voltage of the input source for monitoring by the selected monitoring range.

In the above described example embodiments, a relay with automatic selection of a compatible electrical path therein for an input source can be provided to a user in that the user is not required to know the different combinatorial ways to connect the relay for different input sources. This can advantageously reduce problems associated with incorrect connection of the relay to a particular power source and also problems associated with troubleshooting time and incorrect product returns. Furthermore, relays can be provided with wide ranges such that the number of products (each with narrower ranges) to be made available can be reduced. This can also provide a plug-n-play device for novice users. Such a device can enhance user-friendliness and have simplified user interfaces. The inventors have recognised that the described example embodiments can be applied to control relays and timer relay products such that a larger number of users can be attracted to using such devices.

Although the above example embodiments have been described as such, it will be appreciated that various modifications, alternatives and/or variations may be made. Some alternatives, amongst others, are described below. It will be appreciated that the alternatives are not exhaustive and are not limited to those described below.

One or more of the resistors of the resistor array can have a fixed resistance or a variable resistance. The resistors in the resistor array may be arranged in series with one another, in parallel with one another or in a mixture of series and parallel configurations. In one embodiment, the different electrical paths provided by the relay comprise different electrical resistance in each path. The difference in resistance in the different electrical paths may be provided by the resistor array. Accordingly, the resistors in the resistor array can be arranged in a particular manner such that when in cooperation with the switching module, the resistor array provides different electrical paths of different electrical resistance from an input source to the processing module. In addition, the processing module can automatically select a monitoring range based on a voltage drop across the resistor array.

The switching module of the relay may comprise more than two switches, each being operable in an open state or a closed state. The number of switches in the switching module may be selected from the group consisting of at least 3, at least 4, at least 5, at least 6, at least 7, at least 8, at least 9 or at least 10. In some embodiments, the open state of a switch means that a current is not capable of passing from an input source to the processing module via the switch. In some embodiments, the closed state of the switch means that a current is capable of passing from an input source to the processing module via the switch. The closed state of the switch may correspond to an "on" state and the open state of the switch may correspond to an "off" state. In one embodiment, the switches of the switching module are to be differentiated from the relay switch of the relay. In this embodiment, the switches of the switching module do not directly control a downstream circuit that is electrically coupled to the relay switch, which instead is controlled by the relay switch. In such an embodiment, the relay switch switches on and off in a manner that is independent of the state of the switches in the switching module, and is triggered based on a trigger signal sent from the processing module.

In some embodiments, the relay switch provides or disrupts electrical communication between an input source and an external circuitry both independently coupled to the relay. In these embodiments, the relay serves as an intermediate control between the input source and the external circuitry. The external circuitry may be part of an external device that is coupled to the relay.

In one embodiment, no more than one of the switches in the switching module is in the closed state at any one point of time. In other words, in such embodiment, only one of the switches in the switching module is in the closed state at any one point of time. In such embodiments, each closed switch provides a single electrical path from the input source to the switching module. However, in other embodiments, more than one switch may be closed at one point of time. In such embodiments, more than one switch may be closed to provide a single electrical path from the input source to the switching module. In some embodiments, a particular switch is in the closed state by default until the processing module instructs that switch to be in an open state. In one embodiment, the closed state of each one of the switches corresponds to a respective monitoring range such that each one of the switches remains in its closed state when the input parameter is within its respective monitoring range.

In one embodiment, the processing module coupled to the switching module is capable of automatically controlling the operation of the switches in the switching module as well as the operation of the relay switch. The control of the operation of the switches in the switching module may be based on different factors from the control of the operation of the switches in the switching module. The processing module may comprise one or more processors. In some embodiments, the processing module may comprise one processor for controlling the operation of the switches in the switching module and another processor for controlling the operation of the relay switch. In some other embodiments, a single processor is used to control the operation of the switches in the switching module and the operation of the relay switch. The processing module may have other functions other than controlling the switching module and relay switch. The processing module, for example, may monitor an input parameter from the input source; and/or calculate a value of the input parameter; and/or compare the calculated value against a set of predetermined conditions, and/or determine whether to send a trigger signal to the relay switch.

In some embodiments, the processing module is configured to monitor an input parameter from the input source and to instruct at least one of the switches of the switching module to be in the open state or the closed state based on the input parameter. The input parameter is derived from at least one of a voltage and a current of the input source. In some embodiments, the input parameter comprises the root mean square value of at least one of a voltage and a current of the input source. Accordingly, the input source may be a voltage source or a current source. In one embodiment, the input source is a power source.

In some embodiments, the processing module can control the relay switch by monitoring one or more characteristics of the input source. If one or more characteristics of the input source meets a set of one or more predetermined conditions, a trigger signal may be sent to the relay switch to turn the relay switch on/off. The one or more characteristics is selected from group consisting of single phase voltage, three phase voltage, single phase current and power. The predetermined conditions may be user set or automatically set by generating a set of conditions based on a value of the input source.

The processing module may comprise one or more resistors that are separate from the resistors in the resistor array. The processing module may also comprise a memory for storing values therein.

In one embodiment, the disclosed relay comprises no more than two input terminals for coupling the resistor array to the input source. Preferably, the relay comprises only two input terminals. In one embodiment, with one terminal automatically grounded, there is only one terminal for connecting the relay to the input source.

The relay may be adapted for use with a first input source having a first input parameter and a second input source having a second input parameter, the ratio of the first input parameter to the second input parameter being at least about 100 times. The ratio of the first input parameter to the second input parameter may be selected from the group consisting of at least about 100 times, at least about 500 times, at least about 1000 times, at least about 2000 times, at least about 3000 times, at least about 4000 times, at least about 5000 times, at least about 6000 times, at least about 7000 times, at least about 8000 times, at least about 9000 times, at least about 10000 times, at least about 11000 times and at least about 120000 times. Preferably, the ratio is selected from at least one of about 7500 times and at least about 12000 times. The ratio of the first input parameter to the second input parameter may also be more than any one of the numerical values listed above. In one embodiment whereby the relay has only one terminal for connecting the relay to the input source, the ratio of the first input parameter to the second input parameter is at least more than about 10 times. The ratio of the first input parameter to the second input parameter may also be more than any one of the numerical values listed above. In one embodiment, if the input parameter is a current, the relay is compatible for use with a current source having a current rating within the range of from about 0.002 A to about 15 A. In one embodiment, if the input parameter is a voltage, the relay is compatible for use with a voltage source having a voltage rating ranging from about 0.05 V to about 600 V. Thus, it is possible to provide a ratio of a first monitoring range to a second monitoring range that is at least 5000.

The relay may further comprise at least one of a voltage protection module or a current protection module coupled to the processing module for substantially preventing damage to the processing module caused by the electrical properties of the input source. The voltage protection module may limit an input voltage of the source within a preset range. The current protection module may limit an input current travelling to the processing module within a preset range. Accordingly, the voltage protection module and current protection module may substantially protect the processing module against a surge in electrical current travelling from the input source to the processing module.

The relay disclosed herein may also further comprise a signal conditioning module coupled to the processing module for conditioning an electrical signal travelling from the input source to the processing module into a suitable form for the processing module. The electrical signal may be conditioned by the signal conditioning module into a form that is appropriate for processing by the processing module. The signal conditioning module may also enhance an incoming electrical signal before passing the enhanced signal to the processing module for processing.

In one embodiment, the signal conditioning module is coupled to both the voltage/current protection module and the processing module and positioned between said modules. Accordingly, the voltage or current protection module substantially prevents damage to the signal conditioning module caused by the electrical properties of the input source.

In one embodiment, the switching module is coupled to both the voltage/current protection module and the resistor array and positioned therebetween. Accordingly, the switching module is configured to provide different electrical paths from the resistor array to the switching module.

In one embodiment, the resistor array, switching module, protection module, signal conditioning module and processing module are arranged in series such that the switching module is disposed between the resistor array and the protection module and the signal conditioning module is disposed between the protection module and processing module.

In one embodiment, the relay further comprises an output module coupled to the processing module. The processing module may obtain a root mean square (RMS) value of the input parameter from the input source and output the RMS value via the output module. In some embodiments, this RMS value can be output to the user visually via the output module. In some embodiments, the RMS value is compared with the one or more predetermined conditions mentioned above to determine if a trigger signal is to be sent to the relay switch.

In one embodiment, the relay further comprises a trigger module. The trigger signal may be sent to the relay switch via the trigger module which can control a switch element of the relay switch.

There is also provided a method of automatically selecting an electrical path within a relay disclosed herein to be compatible with an input source, the method comprising coupling the relay to a source to be monitored; monitoring an input parameter from the input source; and automatically controlling at least one of the switches of the switching module to be in the open state or the closed state based on a value of the input parameter such that a compatible electrical path is provided from the input source to the processing module. This allows an appropriate monitoring range associated with the electrical path to be selected for monitoring the input parameter.

In one embodiment, the step of automatically controlling at least one of the switches of the switching module to be in the open state or the closed state comprises comparing a value of the input parameter with the monitoring range associated with a first switch of the switching module to determine whether the value of the input parameter is within the monitoring range associated with the first switch; and providing the first switch to be in the closed state when the value of the parameter is within the monitoring range associated with the first switch.

In another embodiment, the step of automatically controlling at least one of the switches of the switching module to be in the open state or the closed state comprises comparing a value of the input parameter with the monitoring range associated with a first switch of the switching module to determine whether the value of the input parameter is within the monitoring range associated with the first switch; providing the first switch to be in the open state when the value of the parameter is outside the monitoring range associated with the first switch; comparing the value of the input parameter with the monitoring range associated with a second switch of the switching module to determine whether the value of input parameter is within the monitoring range associated with the second switch; and providing the second switch to be in the closed state when the value of the parameter is within the monitoring range associated with the second switch.

In one embodiment, the step of automatically controlling at least one of the switches of the switching module to be in the open state or the closed state comprises (i) comparing a value of the input parameter with the monitoring range associated with one switch of the switching module to determine whether the value of the input parameter is within the monitoring range associated with that switch; (ii) providing the switch to be in the open state when the value of the parameter is outside the monitoring range associated with the switch or in the closed state when the value of the parameter is within the monitoring range associated with the switch; and repeating steps (i) and (ii) with each of the other switches until the value of the parameter is determined to be inside the monitoring range associated with one of the switches in the switching module and that switch is provided in a closed state.

In one embodiment, a first switch of the switching module is in a closed state by default while the remaining switches are in the open state by default. In this embodiment, the processing module first monitors a value of the input parameter of the input source and compares it with the monitoring range associated with a first switch to determine whether the value of the input parameter is within the monitoring range associated with the first switch. If affirmative, the first switch remains in the closed state. Otherwise, the processing module triggers the first switch to be in the open state and provides a next second switch in the closed state. In this embodiment, the processing module then monitors the value of the input parameter of the input source and compares it with the monitoring range associated with the second switch to determine whether the value of the input parameter is within the monitoring range associated with the second switch. If affirmative, the second switch remains in the closed state. Otherwise, the processing module triggers the second switch to be in the open state and provides a next third switch in the closed state and the process continues until a switch having an associated monitoring range that is compatible with the value of the input parameter is located and provided in a closed state.

There is also provided a computer readable data storage medium having stored thereon computer code means for instructing a processing module of a relay disclosed herein to execute a method disclosed herein for selecting an electrical path within the relay that is compatible with an input source and/or selecting a monitoring range for monitoring the input source.

Figure 7:
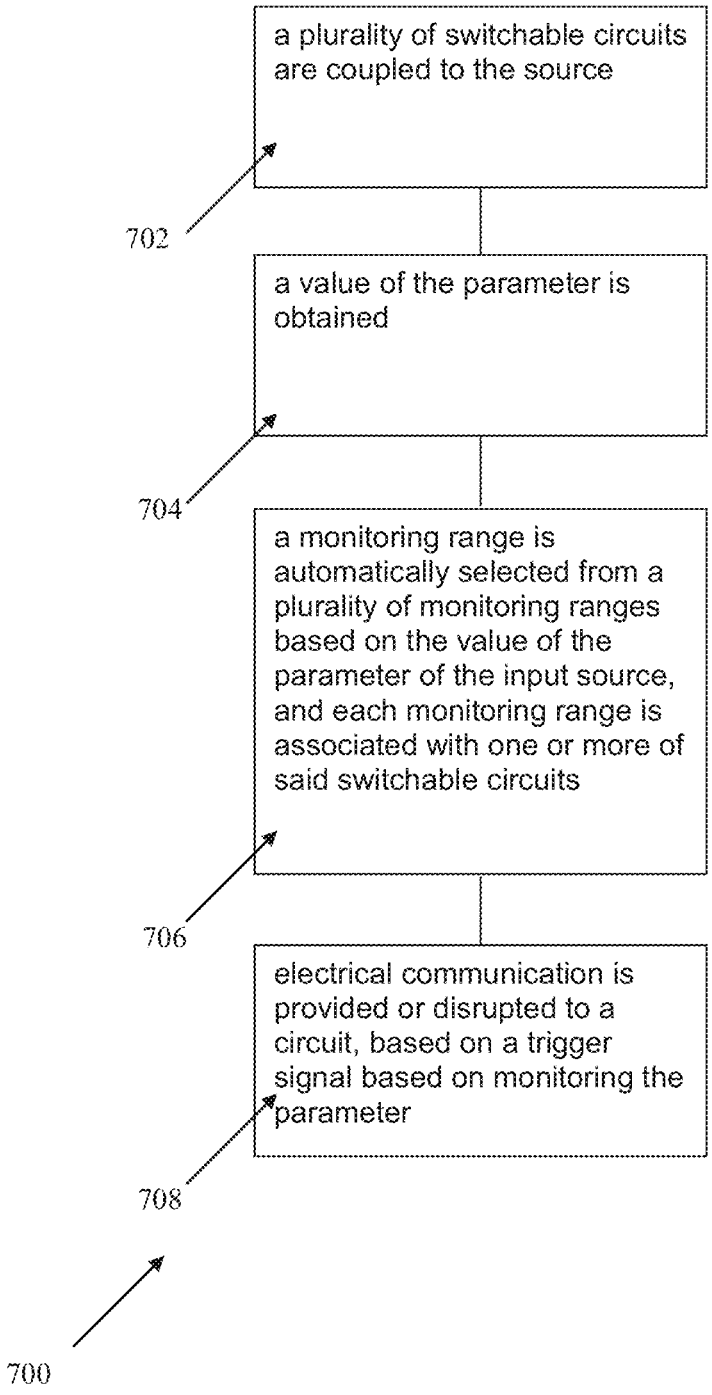
FIG.7 is a schematic flowchart for illustrating a method for monitoring a parameter of an input source in an example embodiment.

FIG. 7 is a schematic flowchart 700 for illustrating a method for monitoring a parameter of an input source in an example embodiment. At step 702, a plurality of switchable circuits are coupled to the source. At step 704, a value of the parameter is obtained. At step 706, a monitoring range is automatically selected from a plurality of monitoring ranges based on the value of the parameter of the input source, and each monitoring range is associated with one or more of said switchable circuits. At step 708, electrical communication is provided or disrupted to a circuit, based on a trigger signal based on monitoring the parameter. It will be appreciated that the circuit in step 708 can refer to a downstream circuit that is affected by the relay actions e.g. the triggering causing a disruption etc.

In some example embodiments, the monitoring is not limited to assessing a parameter value against conditions but can include a reading of the parameter value.

Further, although the switching module and resistor array has been described above, in certain example embodiments, it will be appreciated that the components are not limited as such. In such embodiments, a plurality of switchable circuits are provided coupled to the one or more terminals of the relay. The processing module is coupled to the plurality of switchable circuits for automatically selecting a monitoring range from a plurality of monitoring ranges based on a value of the parameter of the source to be monitored. Similar to monitoring ranges being associated with one or more switches, each monitoring range is associated with one or more of the switchable circuits. In such embodiments, a relay switch can be provided downstream to provide or disrupt electrical communication to a downstream circuit based on a trigger signal provided by the processing module (i.e. relay action).

It will be appreciated by a person skilled in the art that other variations and/or modifications may be made to the specific embodiments without departing from the spirit or scope of the invention as broadly described. The present embodiments are, therefore, to be considered in all respects to be illustrative and not restrictive.

The invention claimed is:

1. A relay for automatically selecting a monitoring range for monitoring a parameter of an input source, the relay comprising:

one or more terminals for coupling to the input source;

a plurality of switchable circuits coupled to the one or more terminals;

a processing module coupled to the plurality of switchable circuits for automatically selecting a monitoring range from a plurality of monitoring ranges based on a value of the parameter of the input source, each monitoring range associated with one or more of said switchable circuits; and a relay switch configured to provide or disrupt electrical communication to a circuit based on a trigger signal provided by the processing module.

2. The relay of claim 1, further comprising a switching module for implementing the plurality of switchable circuits, the switching module comprising at least two switches being each operable in an open state or a closed state, wherein the at least two switches are configured to provide different electrical paths from the input source to the processing module based on their individual open and closed states.

3. The relay of 2, wherein the processing module is configured to instruct at least one switch of the at least two switches of the switching module to be in the open state or the closed state based on the value of the parameter of the input source.

4. The relay of 3, wherein the processing module is configured to sample the value of the parameter of the input source and to generate an assessment of the plurality of monitoring ranges for automatically selecting the monitoring range.

5. The relay of claim 4, wherein the assessment is based on assessing respective upper and lower boundaries of the plurality of monitoring ranges based on the sampled value.

6. The relay of claim 2, wherein the closed state of each switch of the at least two switches corresponds to a respective monitoring range such that each switch of the at least two switches remains in the closed state when the value of the parameter is within the respective monitoring range.

7. The relay of claim 1, further comprising a resistor array for coupling the switching module to the input source, the resistor array comprising a plurality of resistors to provide different electrical resistance from the input source to the processing module.

8. The relay of claim 7, wherein the processing module is configured to automatically select the monitoring range based on a voltage drop across the resistor array.

9. The relay of claim 1, wherein the parameter of the input source comprises at least one of a voltage and a current of the input source.

10. The relay of claim 1, wherein the trigger signal is provided by the processing module when one or more characteristics of the input source meets one or more predetermined conditions, wherein the one or more characteristics are selected from at least one of a single phase voltage, a three phase voltage, a single phase current and power.

11. The relay of claim 10, wherein the relay is configured such that the predetermined conditions may be set by a user.

12. A method for monitoring a parameter of an input source, the method comprising:

coupling a plurality of switchable circuits to the input source;

obtaining a value of the parameter of the input source;

selecting a monitoring range from a plurality of monitoring ranges based on the value of the parameter of the input source, each monitoring range being associated with one or more switches of the plurality of switchable circuits; and providing or disrupting electrical communication to a circuit, based on a trigger signal based on monitoring the parameter.

13. The method of claim 12, further comprising providing a switching module for implementing the plurality of switchable circuits, the switching module comprising at least two switches of the plurality of switches being each operable in an open state or a closed state, wherein the at least two switches are configured to provide different electrical paths based on their individual open and closed states.

14. The method of 13, wherein selecting the monitoring range comprises instructing at least one switch of the at least two switches of the switching module to be in the open state or the closed state based on the value of the parameter of the input source.

15. The method of claim 12, further comprising sampling the value of the parameter of the input source and assessing the plurality of monitoring ranges for automatically selecting the monitoring range.

16. The method of claim 15, further comprising assessing respective upper and lower boundaries of the plurality of monitoring ranges based on the sampled value.

17. The method of claim 13, wherein the closed state of each switch of the at least two switches corresponds to a respective monitoring range such that each switch of the at least two switches remains in the closed state when the value of the parameter is within the respective monitoring range.

18. The method of claim 12, further comprising generating the trigger signal based on one or more characteristics of the input source meeting one or more predetermined conditions, wherein the one or more characteristics is selected from at least one of a single phase voltage, a three phase voltage, a single phase current and power.

19. The method of claim 18, wherein selecting the monitoring range further comprises:

i. comparing the value of the parameter with a respective monitoring range of a first switch of the switching module to determine whether the value is within the monitoring range of the first switch;

ii. setting the first switch to the open state if the value is outside the monitoring range of the first switch, or in the closed state if the value is within the monitoring range of the first switch;

iii. repeating steps (i) and (ii) with each switch of the at least two switches until the value is determined to be inside the monitoring range of one switch of the at least two switches in the switching module and the one switch is in a closed state.

20. A non-transitory computer readable data storage medium storing instructions for monitoring a parameter of an input source, the instructions being executable by a processing module of the relay, the instructions configured to instruct the relay to:

couple a plurality of switchable circuits to the source;

obtain a value of the parameter of the input source;

select a monitoring range from a plurality of monitoring ranges based on the value of the parameter of the input source, each monitoring range associated with one or more switches of the plurality of switchable circuits; and providing or disrupting electrical communication to a circuit, based on a trigger signal based on monitoring the parameter.

* * * * *